United States Patent [19]

Jones

[11] Patent Number: 4,500,571

[45] Date of Patent: Feb. 19, 1985

[54] PICTURE

[76] Inventor: William A. Jones, P.O. Box 189, Everett, Wash. 98201

[21] Appl. No.: 426,604

[22] Filed: Sep. 29, 1982

Related U.S. Application Data

[63] Continuation-in-part of Ser. No. 284,939, Jul. 20, 1981.

[51] Int. Cl.[3] ..... B44C 5/04

[52] U.S. Cl. ..... 428/13; 428/542.2; 428/913.3

[58] Field of Search ..... 428/14, 13, 30; 427/287, 269; 40/563, 160; 434/81, 82, 84, 85, 87

[56] References Cited

U.S. PATENT DOCUMENTS

| | | | |
|---|---|---|---|
| 1,466,107 | 8/1923 | Aloe | 40/563 |
| 1,711,701 | 5/1929 | Speck | 428/14 |
| 2,577,320 | 12/1951 | Fenyo | 428/905 X |
| 2,980,533 | 4/1961 | Charlton | 428/13 X |
| 3,099,544 | 7/1963 | Sheesley | 427/287 X |
| 3,943,648 | 3/1976 | Sterne | 428/30 X |

FOREIGN PATENT DOCUMENTS

| | | | |
|---|---|---|---|
| 1288514 | 2/1962 | France | 428/38 |

*Primary Examiner*—Henry F. Epstein
*Attorney, Agent, or Firm*—Paul H. Gallagher

[57] ABSTRACT

A transparent panel has particles of transparent plastic material applied to it in a pattern to depict a person or thing. The panel, with the picture thus formed, is fitted to the open side of a box, lined with black velvet. The picture is mounted in conjunction with a raking light so as to prevent glare to an observer.

8 Claims, 6 Drawing Figures

PICTURE

This application is a continuation-in-part of my prior and co-pending application Ser. No. 284,939, filed July 20. 1981.

OBJECTS OF THE INVENTION

A broad object of the invention is to provide a new picture.

A more specific object is to provide such a picture, wherein a very unusual effect is produced by utilizing a transparent mounting member, painting material that is both transparent and colored, and light absorbing background.

DESCRIPTION OF A PREFERRED EMBODIMENT

Figure 1:
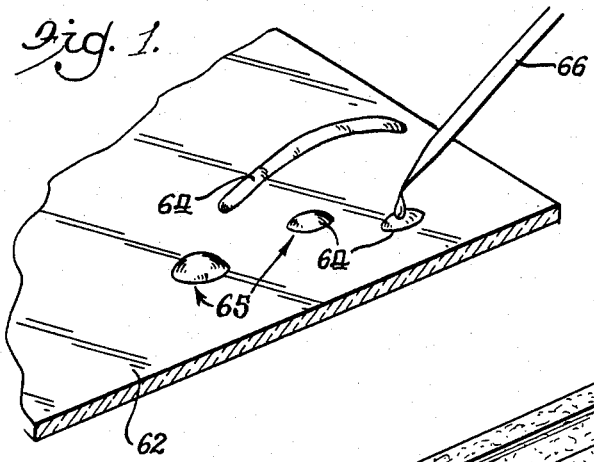
FIG. 1 is a fragmentary perspective view of a transparent panel, forming a component of a picture made according to the invention.
Figure 3:
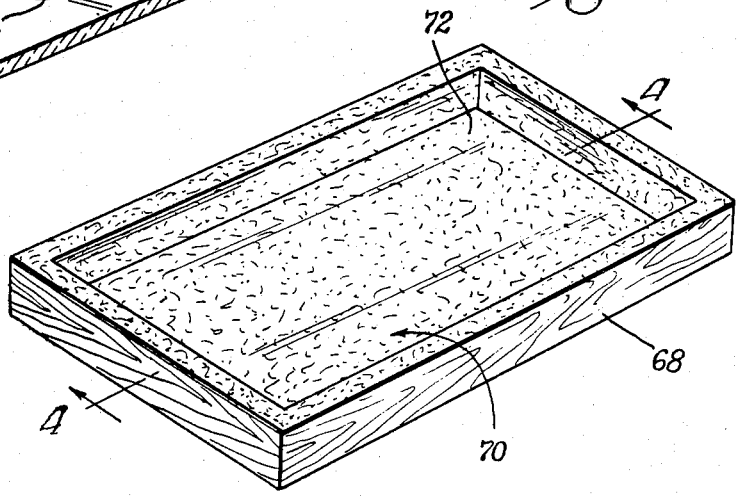
FIG. 3 is a perspective view of a box, to which the panel of FIG. 1 is applied.

Referring in detail to the drawings, FIG. 1 shows a glass panel 62 and plastic material 64 deposited on the glass panel in a pattern to represent the desired picture. The material 64, also known as filler material, is placed in discrete portions or particles, such as round droplets or lines and other elements, of various sizes, shapes and proportions. These particles are indicated generally at 65. In the present case round droplets and a line or elongated element are shown but there is no limit to the size, shape and proportions that may be used to depict the picture intended.

The filler material 64 is a mixture of several ingredients. It includes a casting resin, a thixotropic material, a dye, and a catalyst. The casting resin, a polyester, chemically inert, in liquid form, and clear, does not harden by evaporation. The thixotropic material is a silicon in a form of a powder, and is added to the casting resin to thicken it. It is chemically inert in the casting resin. The dye is then added, this being preferably transparent. Finally the catalyst is added to harden it, this being preferably a methyl ethyl ketone. The mixture thus prepared is transparent. All of the foregoing materials are now on the market, and known to artists and craftsmen. The material remains in pliant form for a time, enabling it to be applied and worked, but it hardens after a suitable period, such for example as 15–20 minutes. Accordingly only a small amount of the material need be prepared at a time.

The filler material 64 may be applied to the panel 62 by any suitable instrument such as indicated at 66 which may be a stylus, or a toothpick, etc. which is dipped into the filler material, and upon being withdrawn carries a droplet of the material, which is then permitted to drop off onto the panel 62. The material 64 then hardens and sets, after a period as indicated above, so that the resulting picture may be put in any position without the material falling off.

The droplets of the material 64 having a definite thickness, extending upwardly above the surface of the panel, and they present a curved or lens shape, and a very unusual effect is provided by the picture.

Figure 2:
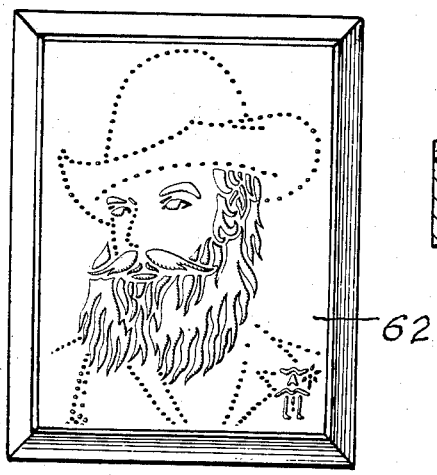
FIG. 2 is a face view of a portrait picture made according to the invention and embodying the panel of FIG. 1.

FIG. 2 is a face view of a picture made according to the foregoing steps. The portions or particles 65, being of any desired size and shape, are applied in such relation to each other to depict the subject desired. Not only may they be of different size and shapes, but the end effect is also accomplished by placement and grouping, spacing apart and variation of the extent of the spacing, and interconnection between some of them.

In making the filler material 64, dies of different colors may be, and most often are, used, for different effects. The filler material is transparent, regardless of the color used, and the overall reflecting effect of the material is maintained regardless of color. It will be appreciated that there is no limit to different effects to be produced by the different colors. The picture of FIG. 2 gives a good indication of the effect of different colors, in representing for example the skin, the beard, and the clothes including hat.

The invention is not limited to the specific materials set out above, but other materials may be used instead. In the case of the filler material 64, such materials as polyurethane and epoxy may be used, although these are not as satisfactory as polyester, and in the case of the panel 62, this need not be of glass, but may be of any of the various transparent plastic materials known, such for example as "Plexiglass," or "Lucite".

Due to the lens shape of the particles 65, a very unusual effect is provided. The light reflects from the overall picture as a whole, not only reflecting from the outer surface of the lens shaped material, but penetrating through the material and reflecting from the back surface thereof, and from the surface of the panel 62 as well, and out to the observer. The lens shape filler material produces a "jewel" effect which is extremely attractive.

It is also within the scope of the invention to mix the colors, i.e., an area may be partially coated with one color, and then material of another color placed thereover, in steps, selectively, placing the second colored material over only the first color, or over a greater area, wherein the first color shows through as only a portion of the whole area. A particularly striking effect is produced in the case of flowers, where petals may have a partial coloring at their inner ends, diminishing in intensity as it proceeds outwardly.

The different shape and size of the particles of the filler material 64, including depth in direction perpendicular to the panel, produces an unusual texture to the picture.

Figure 4:
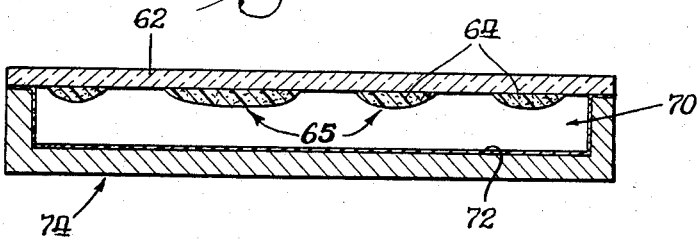
FIG. 4 is a sectional view oriented according to line 14—14 of FIG. 3 and showing the box of that figure, and the panel of FIG. 1 thereon.

After the filler material 64 is applied to the glass panel 62, the panel is then mounted in or on a box 68, as shown in FIG. 4, which has an open front side 70 and is otherwise closed, and is lined with a light-absorbent material such as velvet 72 which may be black, or other dark color. The glass panel is preferrably mounted with the filler material 64 inwardly, and in that case, the pattern is in reverse, for viewing a predetermined picture from the front. This assembly then forms a completed picture or construction 74, and since the filler material 64 is transparent, light reflects from it, both from the front side thereof which is in engagement with the rear surface of the glass panel, and the remote side, in the manner of light reflecting from rain drops.

In the case of the picture 74, the reflection is derived substantially from the glass panel and filler material 64, to the exclusion of course of the lining of the box. Black, light absorbent material has the quality of substantially preventing any stray light reflection, so that the viewer can, effectively, only see the glass panel and the pictorial representation. Additionally, black is found most effective as to be virtually invisible when compared with the glass panel, in contrast to other colors. Because of the transparency of the glass, and of the filler material, light from the rear would shine through the glass and produce undesirable effects, but the box prevents this, and additionally any light that should shine through the glass from the front is absorbed by the black velvet, this preventing any similar bad effects.

Figure 5:
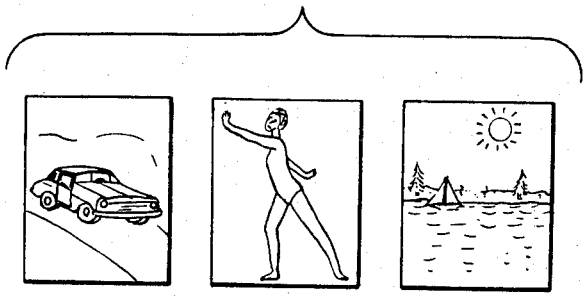
FIG. 5 is a face view of a plurality of pictures indicating widely different kinds of representations.

FIG. 5 is a diagrammatic illustration of several pictures showing different characters or pictorial representations, to indicate the wide range of the applicability of the invention. The pictures may include people, scenes, machines, etc, and in any case the same unusual effect described above is produced.

Figure 6:
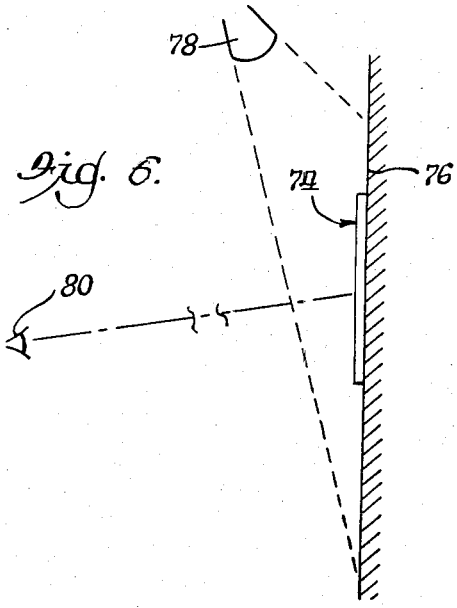
FIG. 6 is a diagrammatic view of a picture made according to the foregoing steps, in place on a wall, and a light illuminating it.

The picture made according to the foregoing may be mounted on a wall 76 as represented in FIG. 6. A raking light 78 is mounted as on the ceiling, above the picture and at such an angle that glare therefrom does not reach the viewer as indicated at 80. In this kind of mounting of the picture, while the glare is eliminated, there is considerable reflected light from the filler material particles 65 and the lens effect reflection of the material is provided to the observer, with the corresponding advantage of having this reflection without the glare.

I claim:

1. A picture comprising, a transparent panel having continuous, regular, and uniform opposite surfaces, transparent substances on a selected one of said surfaces contrasting in color with the panel forming particles in form raised from that surface, the particles being distributed on that surface, and being selectively and individually so dimensioned and proportioned and positioned relative to each other as to form a predetermined picture independently of and separate from that portion of that surface devoid of said substances, said substances being uncovered and exposed and constituting the sole means of forming the picture, and means enclosing one side of the panel with light absorbing material, the transparency of the substances enabling light to enter thereinto from the uncovered side of the panel, and the substances being capable of reflecting light from the front side thereof and from the rear side thereof.

2. A picture according to claim 1 wherein, the enclosing means is constituted by a box frame closed except for an open front side and the panel is mounted on the box frame across the open front side.

3. A picture according to claim 2 wherein, the light absorbing material is constituted by dark-colored velvet.

4. A picture according to claim 3 wherein, the light absorbing material is constituted by black velvet.

5. A picture according to claim 2 wherein, the panel is mounted on the box frame with the transparent said substances positioned inwardly relative to the box frame.

6. A picture according to claim 1 wherein, the transparent substances are colored.

7. A picture according to claim 6 wherein, the transparent substances are of different colors.

8. A picture according to claim 7 wherein, at least certain of the the portions of transparent substances are individually made up of a plurality of colors.

* * * * *